United States Patent [19]

Testa

[11] 4,032,051

[45] June 28, 1977

[54] SELF SEALING CAP FOR A COLLAPSIBLE TUBE

[76] Inventor: James V. Testa, 31 Carlton Terrace, Bloomfield, N.J. 07003

[22] Filed: Dec. 23, 1975

[21] Appl. No.: 643,785

[52] U.S. Cl. ..... 222/492

[51] Int. Cl.[2] ..... B65D 25/40

[58] Field of Search ..... 222/92, 96, 213, 491–496

[56] References Cited

UNITED STATES PATENTS

| | | | |
|---|---|---|---|
| 2,185,323 | 1/1940 | Arnold | 222/496 |
| 2,605,026 | 7/1952 | Wagner | 222/494 X |
| 2,913,152 | 11/1959 | Vidaver | 222/495 X |
| 2,925,935 | 2/1960 | Nomura | 222/92 |
| 3,439,846 | 4/1969 | Evras | 222/494 |
| 3,734,350 | 5/1973 | Waterman et al. | 222/494 X |

*Primary Examiner*—Stanley H. Tollberg
*Assistant Examiner*—Fred A. Silverberg
*Attorney, Agent, or Firm*—Allen D. Brufsky

[57] ABSTRACT

A threaded dispensing cap fits over a delivery opening in a collapsible tube. The dispensing cap has a dispensing hole which is sealed by a bellows. In response to pressure being applied to the tube, the bellows expands and removes the seal whereby the contents of the tube pass through the hole.

2 Claims, 2 Drawing Figures

SELF SEALING CAP FOR A COLLAPSIBLE TUBE

BACKGROUND OF THE INVENTION

1. Field of the Invention

This invention relates to dispensing containers and more particularly to a dispensing cap for a collapsible tube.

2. Description of the Prior Art

In recent years creams, such as toothpaste, shampoo and cosmetics, have been provided in a collapsible tube comprised of a plastic. The tube has threaded neck with a delivery opening therein which is sealable by a threaded cap. The sealing of the delivery opening prevents the cream from drying out and inhibits germs from entering the tube.

In response to an application of a pressure to the tube (typically by a person squeezing the tube), the shape of the tube is changed from an initial shape to a collapsed shape whereby the volume of the tube is decreased. Because of the decrease in the volume, when the delivery opening is unsealed the cream passes therethrough. When the pressure is removed, the shape of the tube changes from the collapsed shape to the initial shape.

A disadvantage of the collapsible tube is that the cap does not seal the delivery opening automatically; the cap is manually screwed on to the delivery opening. Additionally, when the cap is inadvertantly lost, the delivery opening cannot be sealed whereby the cream may dry out and germs may easily enter the tube.

For reasons given hereinbefore, it is desirable to provide an automatic sealing and unsealing of the delivery opening.

SUMMARY OF THE INVENTION

An object of the present invention is to automatically seal and unseal a delivery opening of a collapsible tube.

According to the present invention, a dispensing cap has a hole therethrough which is sealed and unsealed in response to a bellows respectively contracted and expanded.

A dispensing cap, constructed in accordance with the present invention, is continuously connected to a collapsible tube and, therefore, is unlikely to be inadvertantly lost. A cream in the tube is dispensed through a dispensing hole through the cap in response to the tube being squeezed. When the cream is not being dispensed, the dispensing hole is sealed.

Other objects, features and advantages of the present invention will become more apparent in the following light of the following description of a preferred embodiment thereof as illustrated in the accompanying drawing.

DESCRIPTION OF THE PREFERRED EMBODIMENT

Figure 1:
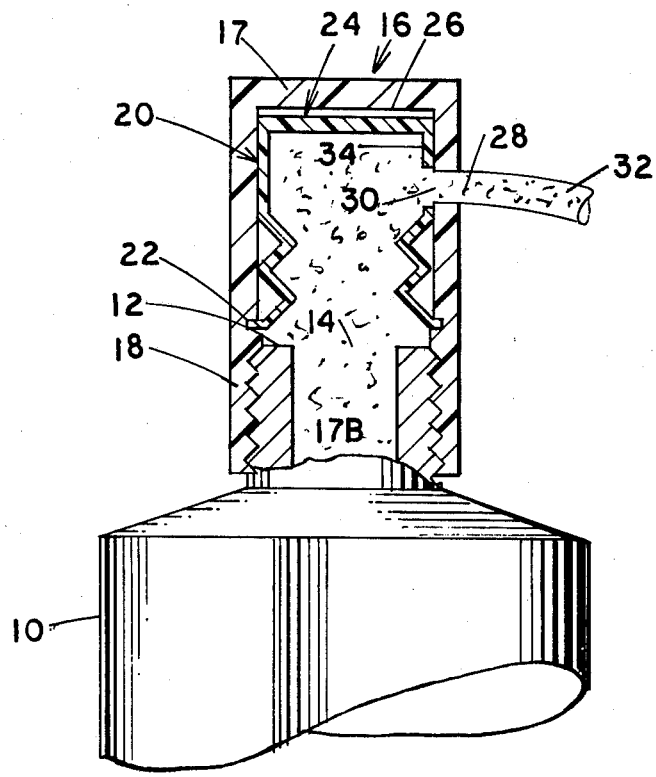
FIG. 1 is a side elevation, with parts broken away, of a preferred embodiment of the present invention.

Referring to FIG. 1, a collapsible tube 10 has a threaded neck 12 with a delivery hole 14 therethrough. As explained hereinafter, the neck 12 is connected to a dispensing cap having a dispensing hole therethrough which is automatically unsealed in response to a pressure being applied to the tube 10.

A dispensing cap 16 includes a cylindrical shell 17 open at a bottom end 17B thereof. The shell 17 has, near the end 17B, threads 18 which engage threads of the neck 12 whereby the cap 16 is connected to the tube 10.

Within the shell 17 is a plastic bellows 20 having an end 22 fixedly connected to the shell 17 near the threads 18. Therefore, when cream from the tube is forced into the shell 17, the bellows 20 expands thereby moving a top 24 of the bellows 20 into juxtaposition with a top 26 of the shell 17.

The shell 17 and the bellows 20 have a dispensing hole 28 and a feed hole 30, respectively therethrough. When the bellows 20 expands, the holes 28, 30 are in alignment whereby the application of the pressure causes a flow of a cream from the tube 10 through the holes 14, 28, 30. In the preferred embodiment, the shell 17 is connected to a nozzle 32 in alignment with the hole 30 thereby providing a passageway from the interior of the shell 16.

Figure 2:
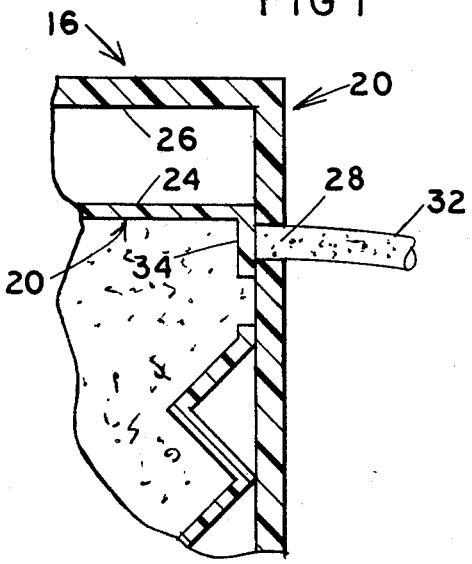
FIG. 2 is a view of a dispensing hole in the embodiment of FIG. 1.

Referring to FIG. 2, the bellows 20 has a sealing segment 34 integral with the top 24. When the pressure is removed, the volume of the tube 10 increases thereby creating a vacuum which causes a contraction of the bellows 20 whereby the top 24 moves out of juxtaposition with the top 26. Because of the contraction, the sealing segment 34 covers the hole 28 thereby sealing the tube 10.

Thus there is described hereinbefore a dispensing cap for a collapsible tube where the cap is automatically sealed and unsealed.

Although the invention has been shown and described with respect to a preferred embodiment thereof, it should be understood by those skilled in the art that various changes and omissions in the form and detail thereof may be made therein without department from the spirit and scope of the invention.

Having thus described a typical embodiment of my invention, that which I claim as new and desire to secure by Letters Patent of the United States is:

1. A dispensing cap for providing a flow of cream from a delivery opening in the neck of a collapsible tube, comprising:

a cylindrical shell open at a bottom end adapted for connection to said neck, said shell having a dispensing hole therethrough in a sidewall thereof;

a contractible and expandible bellows located wholly within the interior of said shell having an open end connected to the interior of said shell to receive a flow of cream from said bottom and into said open end, said bellows having a feed hole therethrough which is in alignment with said dispensing hole in said shell in response to a pressure being applied to said tube whereby said bellows is expanded and cream flows through said delivery opening, said feed hole and said dispensing hole, said bellows including an axially movable sealing segment within the interior of said shell which covers said dispensing hole in response to said bellows being contracted upon cessation of pressure being applied to said tube.

2. The dispensing cap of claim 1 additionally comprising a nozzle connected to said shell in alignment with said dispensing hole thereby providing a passageway from the interior of the shell.

* * * * *